US010427421B1

(12) United States Patent
LeFevre et al.

(10) Patent No.: US 10,427,421 B1
(45) Date of Patent: Oct. 1, 2019

(54) PRINTER AND DRYER FOR DRYING IMAGES ON COATED SUBSTRATES IN AQUEOUS INK PRINTERS

(71) Applicant: Xerox Corporation, Norwalk, CT (US)

(72) Inventors: Jason M. LeFevre, Penfield, NY (US); Paul J. McConville, Webster, NY (US); Douglas K. Herrmann, Webster, NY (US); Chu-Heng Liu, Penfield, NY (US); Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/934,346

(22) Filed: Mar. 23, 2018

(51) Int. Cl.

| | |
|---|---|
| ***B41J 11/00*** | (2006.01) |
| ***B41J 13/08*** | (2006.01) |
| ***B41F 23/04*** | (2006.01) |
| ***B41J 3/54*** | (2006.01) |

(52) U.S. Cl.
CPC ..... *B41J 11/002* (2013.01); *B41F 23/044* (2013.01); *B41J 3/543* (2013.01); *B41J 11/007* (2013.01); *B41J 11/0085* (2013.01); *B41J 13/08* (2013.01)

(58) Field of Classification Search
CPC ..... B41F 23/044; B41F 23/0443; B41F 23/0446; B41J 11/002
See application file for complete search history.

(56) References Cited

U.S. PATENT DOCUMENTS

| | | | | |
|---|---|---|---|---|
| 5,371,531 | A | 12/1994 | Rezanka et al. | |
| 6,042,109 | A * | 3/2000 | Klausbruckner | B41J 11/54 271/184 |
| 6,076,921 | A | 6/2000 | Rezanka et al. | |
| 6,132,038 | A | 10/2000 | Szlucha | |
| 6,428,160 | B2 | 8/2002 | Roy et al. | |
| 6,716,495 | B1 * | 4/2004 | Yoshino | B41J 11/007 162/135 |
| 6,799,759 | B1 | 10/2004 | McNamara et al. | |
| 2006/0176352 | A1 * | 8/2006 | Mihara | B41J 3/60 347/104 |
| 2011/0050777 | A1 * | 3/2011 | Akihiro | B41J 3/543 347/16 |
| 2013/0135408 | A1 * | 5/2013 | Masuda | B41J 11/002 347/102 |

* cited by examiner

*Primary Examiner* — Shelby L Fidler
(74) *Attorney, Agent, or Firm* — Maginot Moore & Beck LLP

(57) ABSTRACT

An aqueous ink printer includes a dryer that enables coated substrates to be printed with aqueous ink images. The dryer is configured to receive substrates from a first substrate transport and to hold a plurality of the substrates for a predetermined period of time to dry the aqueous ink images on the substrates before independently releasing each substrate in the plurality of substrates to a second substrate transport.

16 Claims, 6 Drawing Sheets

PRINTER AND DRYER FOR DRYING IMAGES ON COATED SUBSTRATES IN AQUEOUS INK PRINTERS

TECHNICAL FIELD

This disclosure relates generally to aqueous ink printing systems, and more particularly, to drying systems in such printers.

BACKGROUND

Known aqueous ink printing systems print images on uncoated substrates. Whether an image is printed directly onto a substrate or transferred from a blanket configured about an intermediate transfer member, once the image is on the substrate, the water and other solvents in the ink must be substantially removed to fix the image to the substrate. A dryer is typically positioned after the transfer of the image from the blanket or after the image has been printed on the substrate for removal of the water and solvents. To enable relatively high speed operation of the printer, the dryer heats the substrate and ink to temperatures that typically reach 100° C. Uncoated substrates generally require exposure to the high temperatures generated by the dryer for a relatively brief period of time, such as about 500 to 750 msec, for effective removal of the liquids from the surfaces of the substrates.

Coated substrates are desired for aqueous ink images. The coated substrates are typically used for high quality image brochures and magazine covers. These coated substrates, however, exacerbate the challenges involved with removing water from the ink images as an insufficient amount of water and solvents is removed from the ink image by currently known dryers. One approach to addressing the inadequacy of known dryers is to add one or more uniformly drying stages after the first dryer that repeat the uniform drying performed by the first dryer. This approach suffers from a substantial lengthening of the footprint of the printer and an increase in the energy consumed by the printer from the addition of the other uniform drying stages. Also, adding uniform drying stages to an aqueous ink printing system increases the complexity of the system and can impact reliability of the system. Another approach is to increase the temperature generated by a uniform drying stage; however, an upper limit exists for the temperature generated by the uniform drying stage. At some point, the temperature can reach a level that degrades some substrates or the higher temperature of the substrates can result in the output stack of substrates retaining too much heat for comfortable retrieval of the printed documents. Developing drying devices and methods that enable ink images on coated papers to be efficiently processed without significantly increasing the time for processing the images, the footprint of the printer, the complexity of the printing system, or the temperatures to which the substrates are raised would be beneficial.

SUMMARY

A new aqueous ink printing system includes a drying system that enables efficient drying of aqueous ink images without appreciable additional complexity or significant increases in drying temperatures. The printing system includes at least one printhead configured to eject drops of an aqueous ink onto substrates moving past the at least one printhead to form aqueous ink images on the substrates, a first substrate transport for moving substrates past the at least one printhead, and a dryer configured to receive substrates from the first substrate transport and to hold a plurality of the substrates for a predetermined period of time to dry the aqueous ink images on the substrates before independently releasing each substrate in the plurality of substrates to a second substrate transport, the dryer holding each substrate at an orientation where one end of the substrate is at a higher gravitational potential than an opposite end of the substrate.

A dryer for an aqueous ink printing system enables efficient drying of aqueous ink images without appreciable additional complexity or significant increases in drying temperatures. The dryer includes a housing, a plurality of endless belts that are vertically oriented within the housing, each endless belt being configured with a pivoting member at an end of the endless belt that is at a higher gravitational potential, a plurality of actuators that are operatively connected to the pivoting members in a one-to-one correspondence, and a controller operatively connected to the plurality of actuators, the controller being configured to operate the actuators to pivot the pivoting members selectively to enable substrates to move onto the endless belt associated with the pivoting member pivoted by the operated actuator or to prevent substrates from moving onto the endless belt associated with the pivoting member pivoted by the operated actuator.

BRIEF DESCRIPTION OF THE DRAWINGS

The foregoing aspects and other features of an aqueous ink printing system that includes a drying system that enables efficient drying of aqueous ink images without appreciable additional complexity or significant increases in drying temperatures are explained in the following description, taken in connection with the accompanying drawings.

DETAILED DESCRIPTION

Figure 1A:
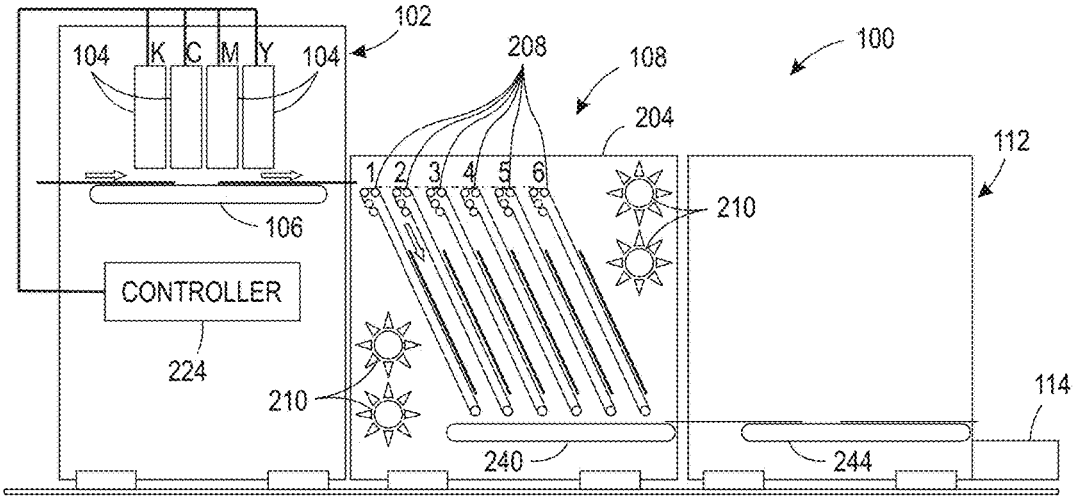
FIG. 1A is a schematic diagram of an aqueous ink printing system that increases the dwell time the printed substrates are exposed to heat without slowing the processing of the printed substrates within the printer.

For a general understanding of the present embodiments, reference is made to the drawings. In the drawings, like reference numerals have been used throughout to designate like elements.

FIG. 1A depicts a block diagram of an aqueous printing system 100 that is configured to print images on coated paper without the energy consumption and elevated substrate temperatures that arise from adding previously known dryers to the printer. The system 100 includes a marking material module 102 having one or more arrays 104 of printheads, a dryer 108, and an output module 112. The printhead arrays 104 are operated by a controller 224 in a known manner to eject drops of aqueous ink onto the substrates carried by substrate transport 106 as the substrates pass the printheads to form ink images on the substrates. The dryer 108 is configured to dry a number of substrates simultaneously rather than one at a time as do previously known dryers in aqueous ink printing systems and it heats the substrates to a temperature that enables the aqueous ink on coated substrates to migrate from the surfaces of the substrates into the bodies of the substrates. To accomplish this goal, the dryer 108 is configured as a series of holding bays 208 within a housing 204 that are operated as a first-in, first-out (FIFO) buffer to expose the substrates to heat generated by the heaters 210 for an amount of time sufficient to make the ink images on the substrates tolerant to touch. The heaters 210 are positioned within the housing 204 to heat the air enclosed within the housing and dry the substrates retained within the bays 208. These heaters 210 can be arrays of various types of radiators of electromagnetic radiation, such as infrared (IR) radiators, microwave radiators, or more conventional heaters such as convection heaters. The holding bays 208 of the dryer 108 receive printed substrates in a predetermined order and then release the printed substrates in the predetermined order to the substrate transport 240 that feeds the substrates to output module 112 for further processing. After output module processing, the substrates are carried by substrate transport 244 to the output tray 114. The time of exposure to heat while the substrates are held in the dryer 108 enables the temperature of the substrates to be elevated to a level that lowers the viscosity of the solvents in the substrates so they migrate away from the surfaces of the substrates into the bodies of the substrates. Thus, the ink image becomes tolerant to touch without subjecting the substrates to temperatures that could degrade the quality of the paper. The substrates can then be stacked in an output tray 114 at temperatures that can be handled by a user. In the figure, six holding bays are shown, but a lesser or greater number of bays could be provided.

Figure 1B:
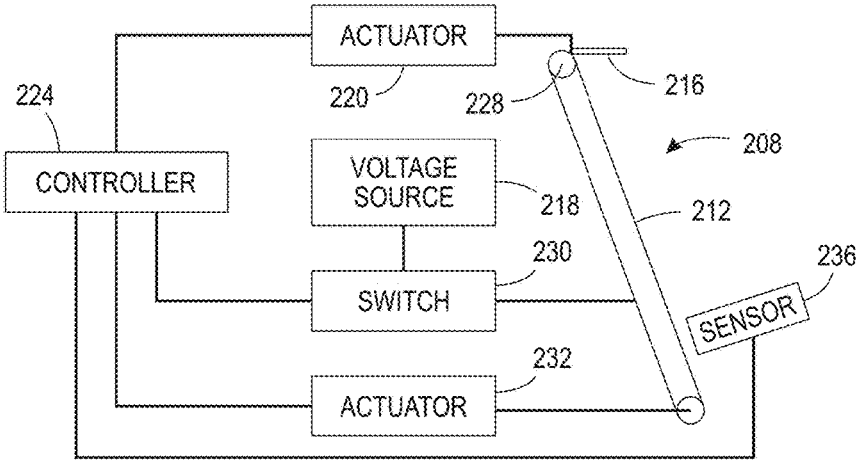
FIG. 1B illustrates a block diagram of the dryer in the aqueous ink printing system of FIG. 1A.

The components of a single holding bay 208 in the housing 204 are depicted in FIG. 1B. Each bay 208 is oriented at an angle with regard to the process direction to reduce the length of the dryer 108 in the process direction. This angular orientation is described as being vertically oriented in this document, although the endless belt 212 is not perpendicular to a plane that is parallel to the substrate transport 106 or the substrate transport 240. Thus, "vertically oriented" as used in this document means an endless belt oriented so the length of the belt against which the substrate rests has one end that is at a higher gravitational potential than an opposite end of the endless belt that is at a lower gravitational potential. To be vertically oriented as meant within this document, the endless belt is within 45 degrees of either side of an axis that is perpendicular to the plane of the substrate transport 106 as depicted in FIG. 1A. Each bay 208 includes an electrostatic endless belt 212 that rotates about rollers 228, at least one of which is driven by an actuator 232 to rotate the endless belt about the rollers 228. Each actuator 232 is operatively connected to the controller 224 so the controller can selectively operate the actuators 232 to start and stop the rotation of the endless belts 212 about the rollers 228 independently of one another. The structure of the electrostatic endless belt 212 is discussed in more detail below. The belt 212 of each bay 208 is electrically connected to a voltage source 218 through a switch 230 that is operated by the controller 224 so the belt 212 generates an electrostatic field that holds a substrate within a bay against the belt 212. At the end of each bay 208 that is closest to the transport 106 is a pivoting member 216 spaced across a width of a path through the dryer 108 in the cross-process direction. Each bay has an associated actuator 220 that is operatively connected to the pivoting member 216 for that bay. The controller 224 is operatively connected to each actuator 220 to operate the actuators 220 to rotate the pivoting members 216 to open and close the entrances to the bays 208 selectively. A sensor 236 is positioned at one end of the bay 208 that is opposite the end of the bay where the pivoting member 216 is located. The sensor 236 is configured to generate a signal indicative of a leading edge of a substrate being detected and the controller 224 is operatively connected to the sensor 236 to deactivate the actuator 232 to cease rotation of the endless belt 212 about the rollers 228 in response to the leading edge of a substrate being detected so the substrate remains with the bay 208.

Figure 2:
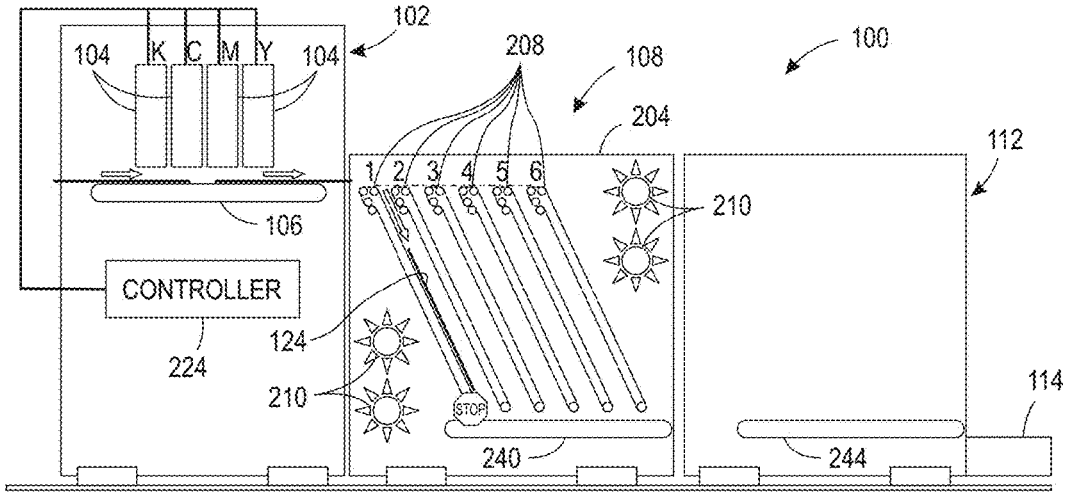
FIG. 2 illustrates the loading of the first bay in the dryer of FIG. 1.

As shown in FIG. 2, which is simplified for purposes of illustration and should be viewed with reference to FIGS. 1A and 1B, a substrate 124 exits the marking module 102 and enters the dryer 108. The controller 224 has operated the actuator 220 for the bay 208 closest to the marking module 102 so the pivoting member 216 rotates to a position immediately adjacent the endless belt 212 to provide access to the bay. Additionally, the controller 224 operates actuator 232 to drive one of the rollers 228 for the endless belt 212 within the bay 208 closest to the marking module to rotate the endless belt 212 about the rollers 228, while also operating a switch 230 to apply a voltage from the voltage source 218 to the endless belt 212. The substrate 124 entering the dryer 108 is pulled by the electrostatic attraction generated by the endless belt 212 and the rotation of the belt 212 into the entrance of the bay closest to the marking module. The belt continues to rotate until the leading edge of the substrate reaches a position near the end of the bay opposite the entrance of the bay at which time the sensor 236 generates a signal indicating the substrate is fully within the bay and the controller 224 deactivates the actuator 232 to stop rotation of the belt 212. The controller 224 also operates the actuator 220 to reverse the rotation of the pivoting member 216 for the bay 208 closest to the marking module 102 to block access to the bay 208 closest to the marking module.

Figure 3A:
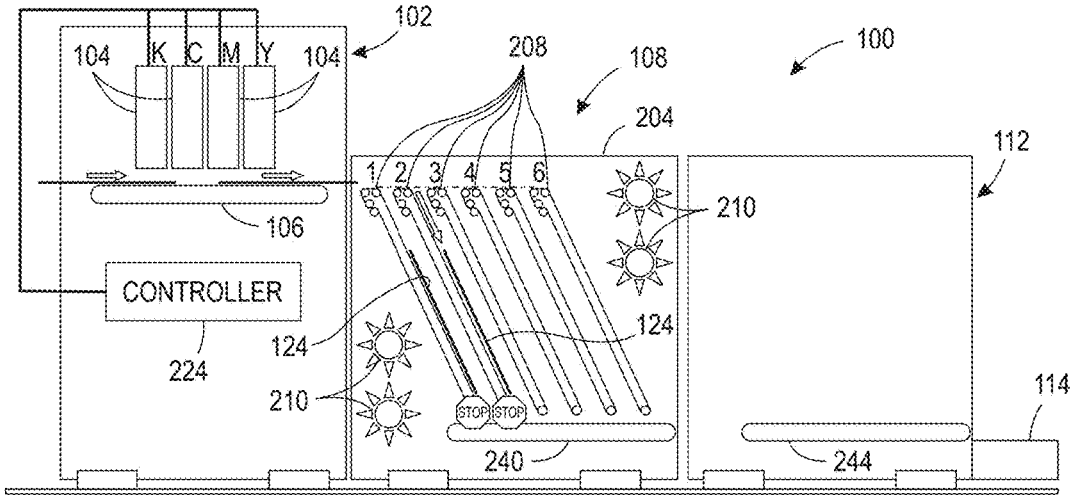
FIG. 3A illustrates the loading of the second bay in the dryer of FIG. 1.
Figure 3B:
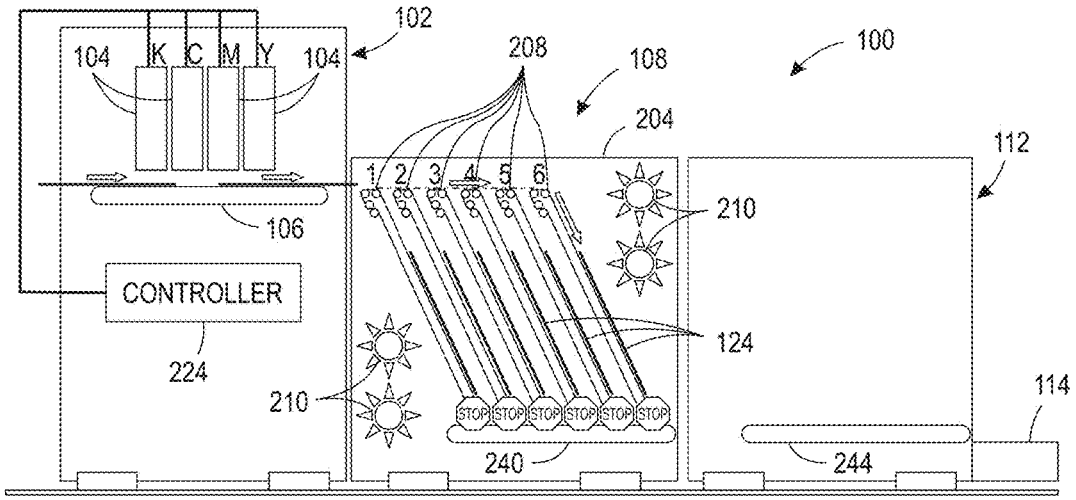
FIG. 3B illustrates the loading of the last bay in the dryer of FIG. 1.

As shown in FIG. 3A, which is simplified for purposes of illustration and should be viewed with reference to FIGS. 1A and 1B, a second substrate exits the marking module 102 and enters the dryer 108. The controller 224 has operated the actuator 220 for the next closest bay 208 to the marking module 102 so the pivoting member 216 for that bay rotates to a position that provides access to the bay while the pivoting member for the bay 208 closest to the marking module 102 continues to block access to that bay. Additionally, the controller 224 operates actuator 232 for the endless belt 212 within the bay 208 next closest to the marking module 102 to rotate the endless belt 212 about the rollers 228, while also operating a switch 230 to apply a voltage to the endless belt 212 in that bay. The substrate entering the dryer 108 passes over the pivoting member 216 blocking access to the bay 208 closest to the marking module 102 so the leading edge of the substrate reaches the entrance to the next closest bay 208 and is pulled by the electrostatic attraction generated by the endless belt 212 and the rotation of the belt into that bay. The belt continues to rotate until the leading edge of the substrate reaches a position near the end of the bay opposite the entrance to the bay at which time the sensor 236 generates a signal indicating the substrate is fully within the bay and the controller 224 deactivates the actuator 232 to stop rotation of the belt 212. The controller 224 also operates the actuator 220 to reverse the rotation of the pivoting member 216 for the bay 208 next closest to the marking module 102 to block access to that bay. The controller 224 continues to operate the actuators 228 and 220 for each successive bay in a similar manner until each bay contains a printed substrate having its unprinted side attracted to the endless belt 216 within each corresponding bay as shown in FIG. 3B.

Figure 4:
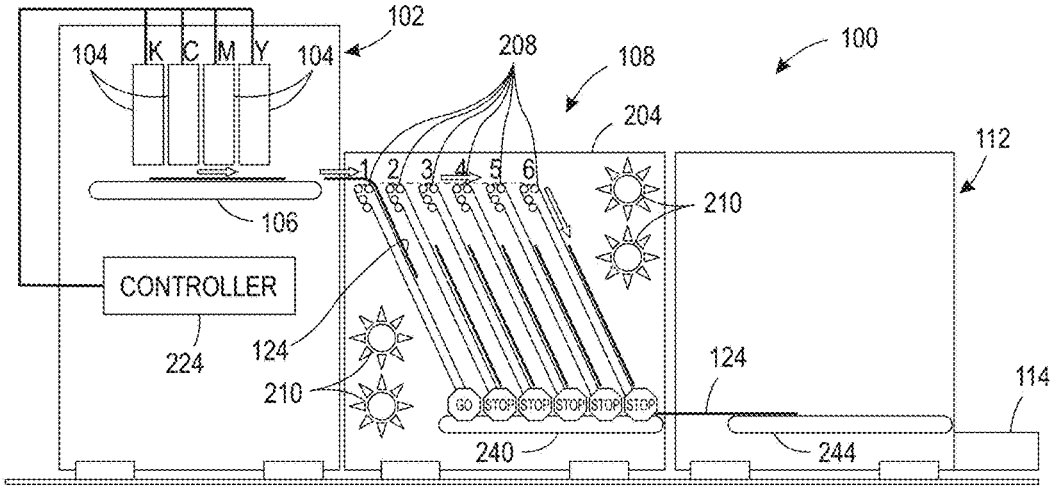
FIG. 4 illustrates the release of a dried substrate from the first bay of the dryer and the reloading of the bay with another printed substrate.

As shown in FIG. 4, which is simplified for purposes of illustration and should be viewed with reference to FIGS. 1A and 1B, the controller 224 responds to the signal from the sensor 236 in the bay 208 most distant from the marking module 102 by deactivating the switch 230 connecting the voltage source 218 to the endless belt 212 in the bay 208 closest to the marking module 102 and activates the actuator 228 to resume rotation of the endless belt 212 about the rollers 228. This action enables the substrate to separate from the endless belt 212 as it exits the bay 208 and is received by substrate transport 240. As the trailing portion of the substrate leaves the bay 208 closest to the marking module, the controller 224 operates the actuator 220 to rotate the pivoting member 216 for the bay 208 closest to the marking module 102 to open the entrance to that bay, while also activating the switch 230 to reconnect the endless belt 212 in that bay to the voltage source 218. Thus, the next substrate entering the dryer 108 is diverted to the bay 208 closest to the marking module 102 as the transport 240 delivers the substrate 124 that exited the bay closest to the transport 106 to the transport 244 in the output module 112. For each successive bay, the controller 224 operates the actuators 220, 228, and the switch 230 to eject a substrate 12 from the bay and open the entrance to the bay for the next entering substrate. Thus, each substrate entering the dryer 108 is exposed to the heat with the dryer for the same period of time without needing to transport the substrate for that entire period of time.

Figure 5A:
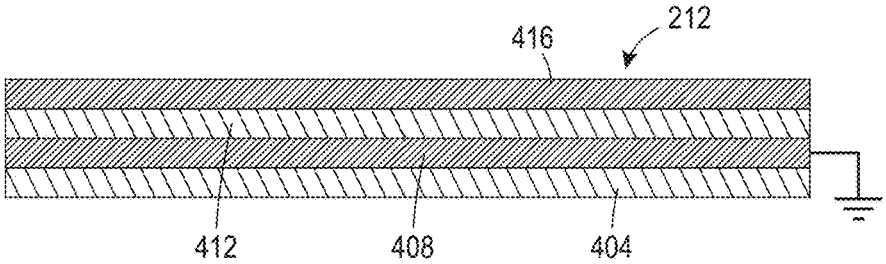
FIG. 5A is a side view of an electrostatic belt used in each bay of the printer shown in FIG. 1.
Figure 5B:
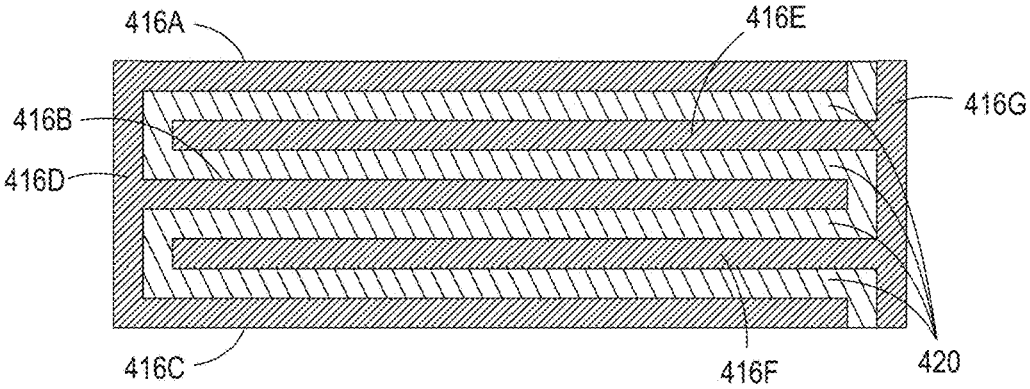
FIG. 5B is a top view of the electrostatic belt shown in FIG. 5A.
Figure 5C:
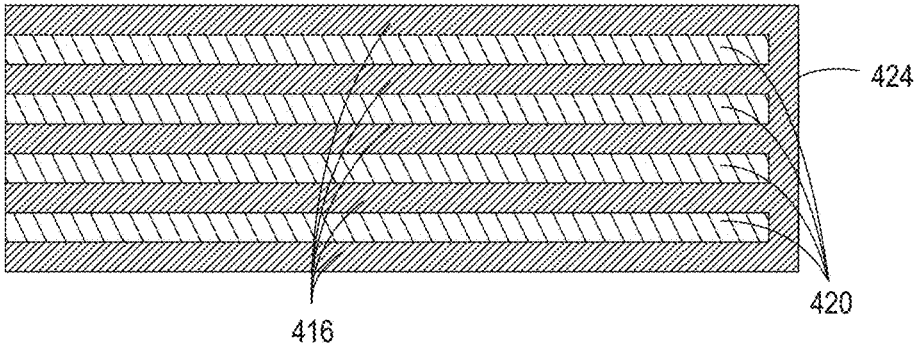
FIG. 5C is a top view of an alternative embodiment of the electrostatic belt that can be used in each bay of the printer shown in FIG. 1.

A side view of the structure of the endless belts 216 is shown in more detail in FIG. 5A. The endless belt 212 has a planar layer of electrically insulating material 404, such as Mylar, on which a planar layer of electrically conductive material 408 of approximately the same size as the layer 404 is laid. This electrically conductive layer 408 is connected to electrical ground to form a grounding plane for the endless belt 212. Another planar layer of electrically insulating material 412 of approximately the same size as the electrically conductive layer 408 is laid on the layer 408. Interleaved strips 416 of electrically conductive material are laid on the layer 412. In the side view of FIG. 5A, these strips 416 look like a plane of material. The top view of the endless belt 212 shown in FIG. 5B reveals that the strips 416 are configured in an arrangement that spatially separates the strips from one another except for the ends connected together by an end strip. As shown in FIG. 5B, strips 416A, 416B, and 416C are connected by end strip 416D to form one electrical conductor, while strips 416E and 416F are connected by end strip 416G to form a second electrical conductor. This arrangement exposes bands 420 of the electrically insulating material 412 and increases the density of the conductors to help form a stronger electrostatic force when the two conductors are electrically connected to a voltage source in the range of about 500V to about 1500V. The electric field is produced at the edges of the conductors and the field is proportional to the voltage applied to the conductors. An additional layer of electrically insulating material can be positioned over the conductive strips to insulate the conductors from one another and from the environment in the bays. In one embodiment, the conductive strips are 5 mm wide and the gaps between the strips is 5 mm. An alternative embodiment of the endless belt 216 is shown in FIG. 5C. In this embodiment, all of the conductive strips 416 are electrically connected by an electrically conductive strip 424 that runs along only one side of the belt to expose the bands 420 of the electrically insulative material.

Figure 6:
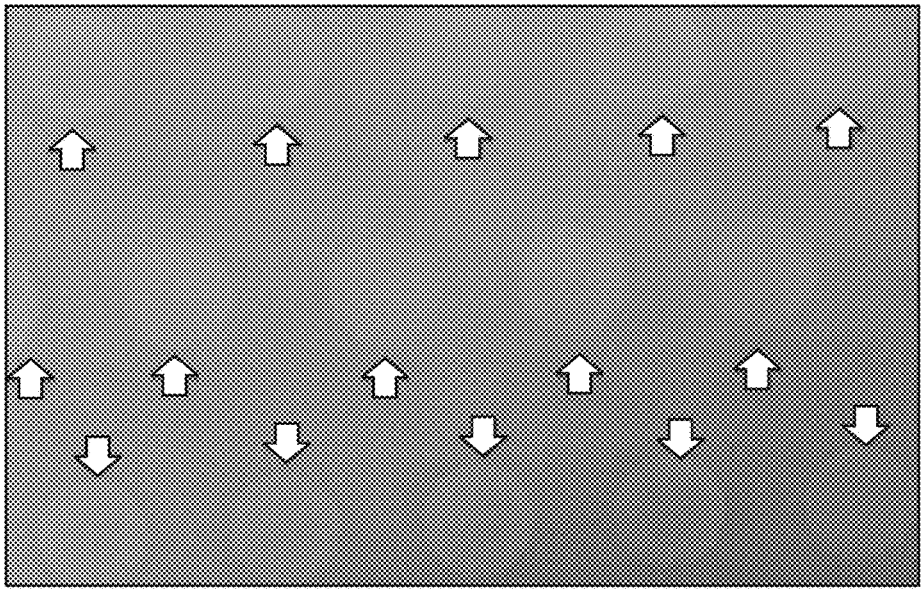
FIG. 6 illustrates an artifact produced by drying an aqueous ink image on a substrate supported by a transport belt having holes to enable an air pressure to hold the substrate against the belt.

Another advantage of the dryer 108 having the bays 208 is the elimination of differential drying of the substrates. Differential drying of substrates through previously known dryers is caused by holes in the transport belt that supports the horizontal substrates as they pass through the dryer. The transport belt is positioned between a source of negative air pressure and the substrates carried by the belt so air can be pulled by the negative air pressure through the substrates and the holes to produce a pressure that helps hold the substrates against the transport belt. The air flow through the portions of the substrates aligned with the holes in the transport belt keeps those portions cooler than the areas that are against solid areas of the transport belt. These cooler areas do not evaporate as much water and solvent as the warmer areas adjacent the solid belt areas. This temperature differential produces artifacts in the ink image as indicated by the arrows in FIG. 6. By holding the substrates within each bay with the electrostatic attraction produced by each electrostatic endless belt, the belt holes are eliminated and the dryer 108 provides more uniform drying across the surface of the substrates so the artifacts caused by differential drying are not produced.

Figure 7A:
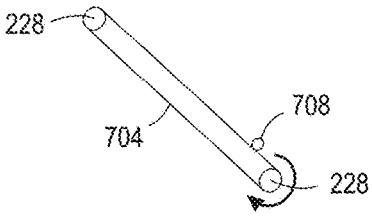
FIG. 7A is a side view of an alternative embodiment of the endless belt for the system of FIG. 1
Figure 7B:
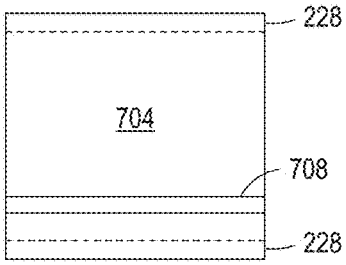
FIG. 7B is a front view of the belt shown in FIG. 7A.

While the embodiments described above use an electrostatic endless belt in each bay to hold the substrate within each bay. An alternative embodiment is shown in FIGS. 7A and 7B. In FIG. 7A, a side view of an endless belt 704 is depicted with a cross-member 708 across the width of the belt to hold the leading edge of the substrate. The front view of FIG. 7B shows this extension of the cross-member 708 across the surface of the belt 704. As the endless belt rotates in response to the predetermined heat exposure time being reached, the cross-member is carried by the belt, as indicated by the arrow in FIG. 7A, to the back side of the endless belt and the substrate is released from the bay to the second transport 240 (FIG. 2, for example).

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An aqueous ink printer comprising:

at least one printhead configured to eject drops of an aqueous ink onto substrates moving past the at least one printhead to form aqueous ink images on the substrates;

a first substrate transport for moving substrates past the at least one printhead; and a dryer configured to receive substrates from the first substrate transport and to hold a plurality of the substrates for a predetermined period of time to dry the aqueous ink images on the substrates before independently releasing each substrate in the plurality of substrates to a second substrate transport, the dryer holding each substrate at an orientation where one end of the substrate is at a higher gravitational potential than an opposite end of the substrate, the dryer comprising:

a housing;

a plurality of endless belts that are vertically oriented within a predetermined range of angles from an axis that is perpendicular to a horizontal plane of the first substrate transport, each endless belt being configured with a pivoting member at an end of the endless belt that is at a higher gravitational potential, each endless belt comprising:

a first electrically insulating layer;

a first electrically conductive layer positioned on the first electrically insulting layer, the first electrically conductive layer being electrically connected to electrical ground;

a second electrically insulating layer positioned on the first electrically conductive layer; and a plurality of electrically conductive strips arranged in a predetermined pattern on the second electrically insulating layer to enable an electrostatic field to form at edges of the strips in response to the electrically conductive strips being electrically connected to an electrical voltage supply, the first and the second electrically insulating layers, the first electrically conductive layer, and the plurality of electrically conductive strips forming an electrostatic endless belt;

a plurality of actuators that are operatively connected to the pivoting members in a one-to-one correspondence; and a controller operatively connected to the plurality of actuators, the controller being configured to operate the actuators to pivot the pivoting members selectively to enable substrates to move onto the endless belt associated with the pivoting member pivoted by the operated actuator or to prevent substrates from moving onto the endless belt associated with the pivoting member pivoted by the operated actuator.

2. The aqueous ink printer of claim 1 wherein the predetermined pattern forms a first electrical conductor from a first group of the electrically conductive strips in the plurality of electrically conductive strips and a second electrical conductor from a second group of electrical conductive strips in the plurality of electrically conductive strips.

3. The aqueous ink printer of claim 1 wherein the predetermined pattern electrically connects the plurality of electrically conductive strips together at one end of each electrically conductive strip and electrically isolates an opposite end of each electrically conductive strip in the plurality of electrically conductive strips.

4. The aqueous ink printer of claim 1, the dryer further comprising:

at least one heater to heat air within the housing to a temperature in a predetermined range.

5. The aqueous ink printer of claim 4 wherein the at least one heater is an array of electromagnetic radiators.

6. The aqueous ink printer of claim 4 wherein the at least one heater is a convection heater.

7. The aqueous ink printer of claim 6, the dryer further comprising:

a voltage source configured to generate an electrical voltage;

a plurality of switches, each switch being configured to electrically connect to the electrostatic endless belts in a one-to-one correspondence; and the controller being operatively connected to the plurality of switches, the controller being further configured to operate the switches to connect each electrostatic endless belt to the electrical voltage source independently of the other electrostatic endless belts.

8. The aqueous ink printer of claim 4 wherein the housing has a vent opening to enable evaporated water and solvent to exit the housing.

9. A dryer for an aqueous ink printer, the dryer comprising:

a housing;

a plurality of endless belts that are vertically oriented within the housing, each endless belt being configured with a pivoting member at an end of the endless belt that is at a higher gravitational potential, each endless belt further comprising:

a first electrically insulting layer;

a first electrically conductive layer positioned on the first electrically insulting layer, the first electrically conductive layer being electrically connected to electrical ground;

a second electrically insulting layer positioned on the first electrically conductive layer; and a plurality of electrically conductive strips arranged in a predetermined pattern on the second electrically insulating layer to enable an electrostatic field to form at edges of the strips in response to the electrically conductive strips being electrically connected to an electrical voltage supply;

a plurality of actuators that are operatively connected to the pivoting members in a one-to-one correspondence; and a controller operatively connected to the plurality of actuators, the controller being configured to operate the actuators to pivot the pivoting members selectively to enable substrates to move onto the endless belt associated with the pivoting member pivoted by the operated actuator or to prevent substrates from moving onto the endless belt associated with the pivoting member pivoted by the operated actuator.

10. The dryer of claim 9 wherein the predetermined pattern forms a first electrical conductor from a first group of the electrically conductive strips in the plurality of electrically conductive strips and a second electrical conductor from a second group of electrical conductive strips in the plurality of electrically conductive strips.

11. The dryer of claim 9 wherein the predetermined pattern electrically connects the plurality of electrically conductive strips together at one end of each electrically conductive strip and electrically isolates an opposite end of each electrically conductive strip in the plurality of electrically conductive strips.

12. The dryer of claim 9 further comprising:

at least one heater to heat air within the housing to a temperature in a predetermined range.

13. The dryer of claim 12 wherein the at least one heater is an array of electromagnetic radiators.

14. The dryer of claim 12 wherein the at least one heater is a convection heater.

15. The dryer of claim 12 wherein the housing has a vent opening to enable evaporated water and solvent to exit the housing.

16. The dryer of claim 15 further comprising:

a voltage source configured to generate an electrical voltage;

a plurality of switches, each switch being configured to electrically connect to the electrostatic endless belts in a one-to-one correspondence; and the controller being operatively connected to the plurality of switches, the controller being further configured to operate the switches to connect each electrostatic endless belt to the electrical voltage source independently of the other electrostatic endless belts.

* * * * *